US008327994B2

(12) United States Patent
Kayani

(10) Patent No.: US 8,327,994 B2
(45) Date of Patent: Dec. 11, 2012

(54) NOTE PROCESSING GROSS DEFECTS REMOVAL METHOD AND APPARATUS

(75) Inventor: Sohail Kayani, Irving, TX (US)

(73) Assignee: Toshiba International Corporation, Houston, TX (US)

( * ) Notice: Subject to any disclaimer, the term of this patent is extended or adjusted under 35 U.S.C. 154(b) by 43 days.

(21) Appl. No.: 12/556,370

(22) Filed: Sep. 9, 2009

(65) Prior Publication Data

US 2010/0059418 A1 Mar. 11, 2010

Related U.S. Application Data

(60) Provisional application No. 61/096,194, filed on Sep. 11, 2008.

(51) Int. Cl.
*G07F 7/04* (2006.01)

(52) U.S. Cl. ..... 194/206

(58) Field of Classification Search ..... 194/206, 194/212, 353; 209/534; 235/379; 902/16, 902/29, 38, 41; 270/30.02; 271/3.15, 10.03
See application file for complete search history.

(56) References Cited

U.S. PATENT DOCUMENTS

| | | | | |
|---|---|---|---|---|
| 4,236,639 | A * | 12/1980 | Boettge et al. | 209/534 |
| 4,757,904 | A | 7/1988 | Ozawa | |
| 5,004,094 | A | 4/1991 | Brandt | |
| 6,565,079 | B1 | 5/2003 | Kakegawa et al. | |
| 7,152,744 | B2 * | 12/2006 | Kunz et al. | 209/534 |
| 2003/0136630 | A1 * | 7/2003 | Miyashita | 194/302 |
| 2007/0000820 | A1 * | 1/2007 | Yui | 209/534 |
| 2007/0122023 | A1 | 5/2007 | Jenrick et al. | |

OTHER PUBLICATIONS

PCT/US2009/056712, international filing date Sep. 11, 2009; See, PCT International Search Report mailed on Apr. 26, 2010 (from parent U.S. Appl. No. 61/096,194, filed Sep. 11, 2008 and U.S. Appl. No. 12/556,370, filed Sep. 9, 2009).

* cited by examiner

*Primary Examiner* — Mark Beauchaine
(74) *Attorney, Agent, or Firm* — Baker Botts L.L.P.

(57) ABSTRACT

A method and apparatus for removing notes having gross defects from a currency processing machine prior to the notes entering the primary detection function of the machine. The invention involves the use of a gross defect detector module which detects notes having gross defects that could jam the machine if such defects were note detected and the notes were allowed to continue down the note path for processing. The invention works in conjunction with a conventional reject pocket located further downstream in the note path for the collection of notes identified as rejects during the subsequent main detection function.

10 Claims, 3 Drawing Sheets

NOTE PROCESSING GROSS DEFECTS REMOVAL METHOD AND APPARATUS

CROSS-REFERENCE TO RELATED APPLICATIONS

This application claims the benefit of provisional Application No. 61/096,194, filed Sep. 11, 2008.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a method for reducing jams and misfeeds in a high speed currency processing machine. Specifically, the invention relates to the use of a gross defects detection and removal module that detects and removes notes having gross defects prior to introduction of the notes into the primary detection and sorting function.

2. Description of Related Art Including Information Disclosed Under 37 CFR 1.97 and 1.98

High speed currency processors are common in the fields of bulk currency processing and are used by central banks, large commercial banks, print works, cash in transit (CIT), and other entities that require the processing of large amounts of currency. In operation, notes that require processing are fed into the high speed currency processing machine by a note feeder. These notes then travel along a high speed conveyor past a number of detectors which detect various characteristics of the note. Based on the note characteristics detected, the note is then routed to any number of pockets for collation. These pockets enable the high speed currency machine to sort notes by fitness level, denomination, origin, authentication, etc. . . .

Once the notes are fed into the high speed currency processing machine they proceed down the conveyor at such high speed that defects in the notes can cause the machine to jam, miss-stack notes in the collating pockets, or improperly recognize and characterize the note characteristics. Such defects that can cause these occurrences include, but are not limited to, large pieces of the notes missing, bad tears in the notes, notes stuck together, and notes having staples embedded in them. In the prior art, the currency processing machines do have a reject pocket for the collection of such notes. However, this reject pocket is located downstream of the various detectors used to detect note characteristics. As a consequence, the notes that arrive in the reject pocket are only of such quality that they can be transported at high speed past the detectors in the first place. If that is not the case, then the note can potentially jam the machine or cause some other failure in the processing sequence that requires the machine to shut down and receive the attention of manual intervention.

Consequently, the need exists for a method and related apparatus for removing notes having gross defects from a high speed currency processing machine prior to the notes entering the primary detection function of the machine. Such method and apparatus should be designed to eliminate from the processing stream only those notes that justify manual review prior to entering the primary detection function of the machine. Yet, this gross detection culling should not slow down the overall speed of the machine or interrupt its function.

SUMMARY OF THE INVENTION

A currency processing machine having a note path, the currency processing machine comprising: a note feeder for introducing notes to the note path; at least one gross defects detector located downstream of the note feeder along the note path; at least one note characteristics detector located downstream of the gross defects detector along the note path; and a cull pocket for collection of notes having gross defects located along the note path between the at least one gross defects detector and the at least one note characteristics detector.

A method for processing currency notes, the method steps comprising: (a) feeding notes into a note path; (b) detecting gross defects in the notes fed into the note path; (c) removing notes having gross defects from the note path; (d) detecting for note characteristics those notes remaining in the note path after the removal of notes of steps (c); and (e) sorting the notes of step (d) based on the characteristics detected during step (d).

Applicant's invention eliminates the jams and other interruptions to the currency processing caused by notes having gross defects without affecting the processing speed or the remaining functionality of the machine. Applicant's cull pocket is not used as a replacement for the traditional rejects pocket found in prior art machines downstream of the primary detection function but, rather, is used in conjunction with such prior art reject pocket.

BRIEF DESCRIPTION OF THE DRAWINGS

The novel features believed characteristic of the invention are set forth in the appended claims. The invention, itself, however, as well a preferred mode of use, further objectives and advantages thereof, will be best understood by reference to the following details description of illustrative embodiments when read in conjunction with the accompanying drawings, wherein:

DETAILED DESCRIPTION

Figure 1:
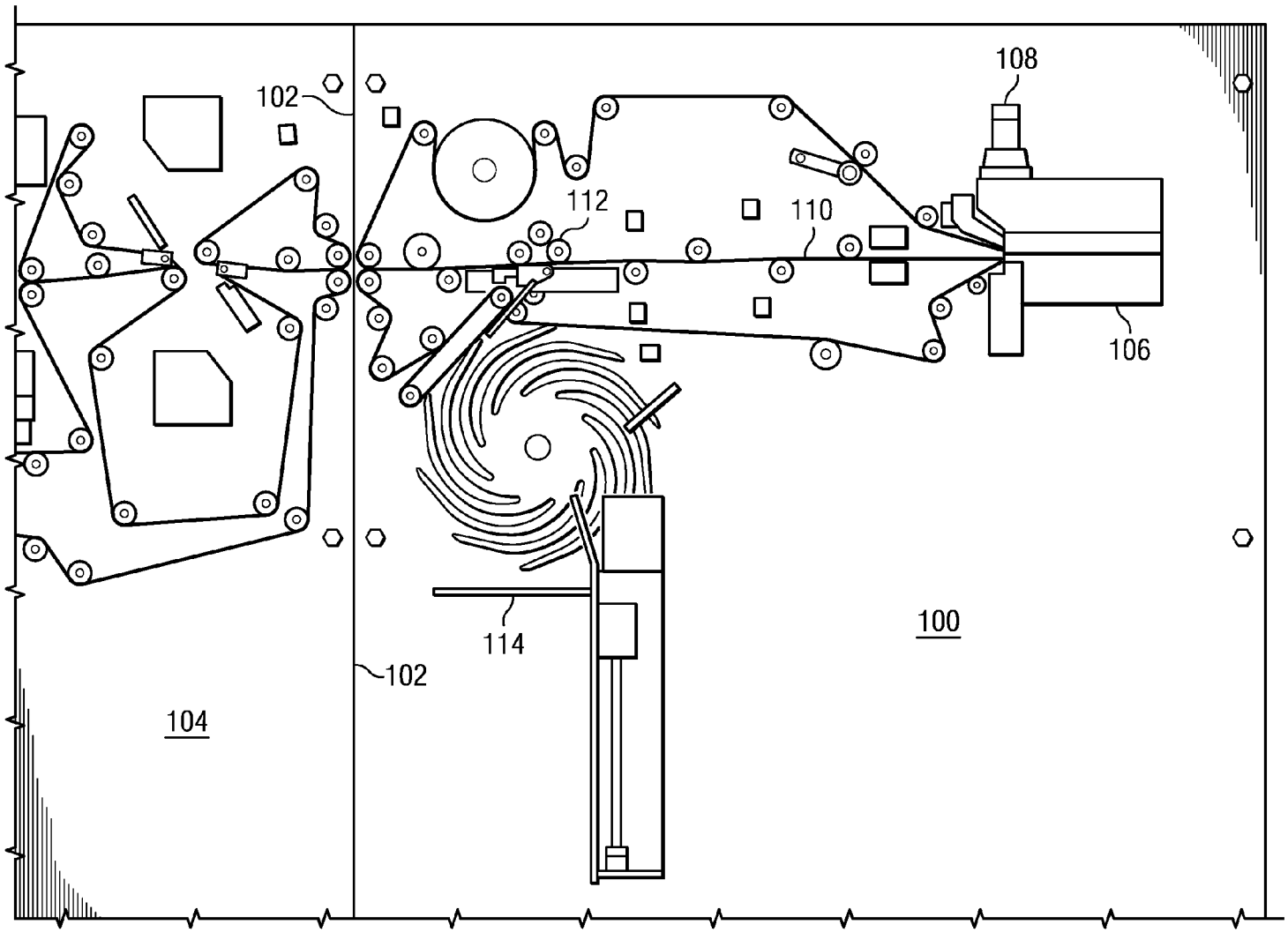
FIG. 1 is a photograph of an embodiment of a gross defects removal module of the present invention.

FIG. 1 is a photograph of a first embodiment of Applicant's invention. Shown is a gross defects detector and culling module 100 mated at a mating interface 102 with a detector module 104. While Applicant's invention is described with regard to FIG. 1 as comprising a separate gross detect and culling module 100 and a separate detector module 104, it should be understood that Applicant's invention can also be used in currency processing machines arranged such that they are not individual modules 100, 104 but, rather, the currency processing is done using one integrated note path, as in prior art machines.

Returning to the module 100 in question, notes enter the module at a note feeder 106. The entry of the notes into the note path 110 by the note feeder defines the most upstream position of the notes in the note path 110 for the purpose of Applicant's use of the convention "upstream" and "downstream." After leaving the note feeder 106, the notes pass at least one detector 108 that detects note characteristics. This note detector 108 can be, for example, a main item presence detector for note identification and detection of mutilation, a multi-item detector for identification of multi-feeds (such as a transmissive detector using dual IR point source irradiation), or a capacitive tape, window, fold, and missing corner detector. The detection function carried out by this at least one detector 108 can involve a single detector or multi-detectors, all of which employ various detection capabilities known in the art as well as innovative detection capabilities developed by Applicant in order to obtain the note characteristics that will enable the logic of the module 100 or currency processing machine itself to determine that a note is unfit for continued processing.

If a note is determined to be unfit for further processing, it need only continue a short distance along the note path 110 before it is selectively removed by means 112 known in the art and deposited in a cull pocket or location 114. Once the rejected notes are deposited in this cull pocket 114, they can be inspected manually.

Notes that are not identified by the at least one detector 108 as having a gross defect continue down the note path 110 to the primary detection function of the currency processing machine, which in the embodiment illustrated in FIG. 1 comprises a separate detection module 104, which is only partially shown.

Figure 2A:
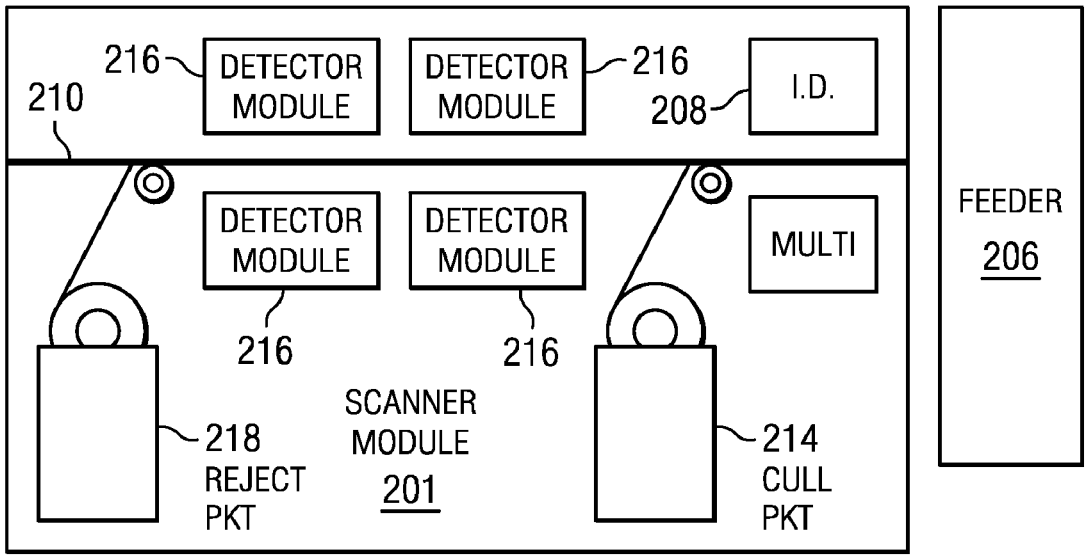
FIG. 2*a* is a schematic representation of a currency processing machine utilizing Applicant's present invention.

FIG. 2*a* is a schematic representation of one embodiment of Applicant's invention in a basic currency processing configuration. Notes are introduced into the currency processing machine 201 by a note feeder 206. The notes immediately pass at least one detector 208. In one embodiment, this detector performs both an identification function and multi-characteristic detection for detecting notes fed into the transport, as well as determining if they are a minimum size for machine processing, if they are skewed, if they have proper note-to-note distance (close feed), and if the notes are multi-notes (more than one note stuck together). In the event a note is detected that has a gross defect that would make it difficult to process, given the tolerances of some of the detection modules later downstream and the speed of transport, the note is identified for removal into a cull pocket 214. Otherwise, the note proceeds along the note path past any number of other detector modules 216 as known in the prior art. These other detector modules 216 identify various note characteristics and can identify notes for a reject pocket 218 or further sorting.

It should be noted that Applicant's invention does not replace the prior art reject or cull pocket 218, but works in conjunction with the reject pocket 218. Only those notes that have gross defects that justify the removal of the notes from the processing that occurs downstream are removed into the cull pocket 214. Otherwise, rejected notes are sorted and placed in the reject pocket 218, as occurs in the prior art.

Figure 2B:
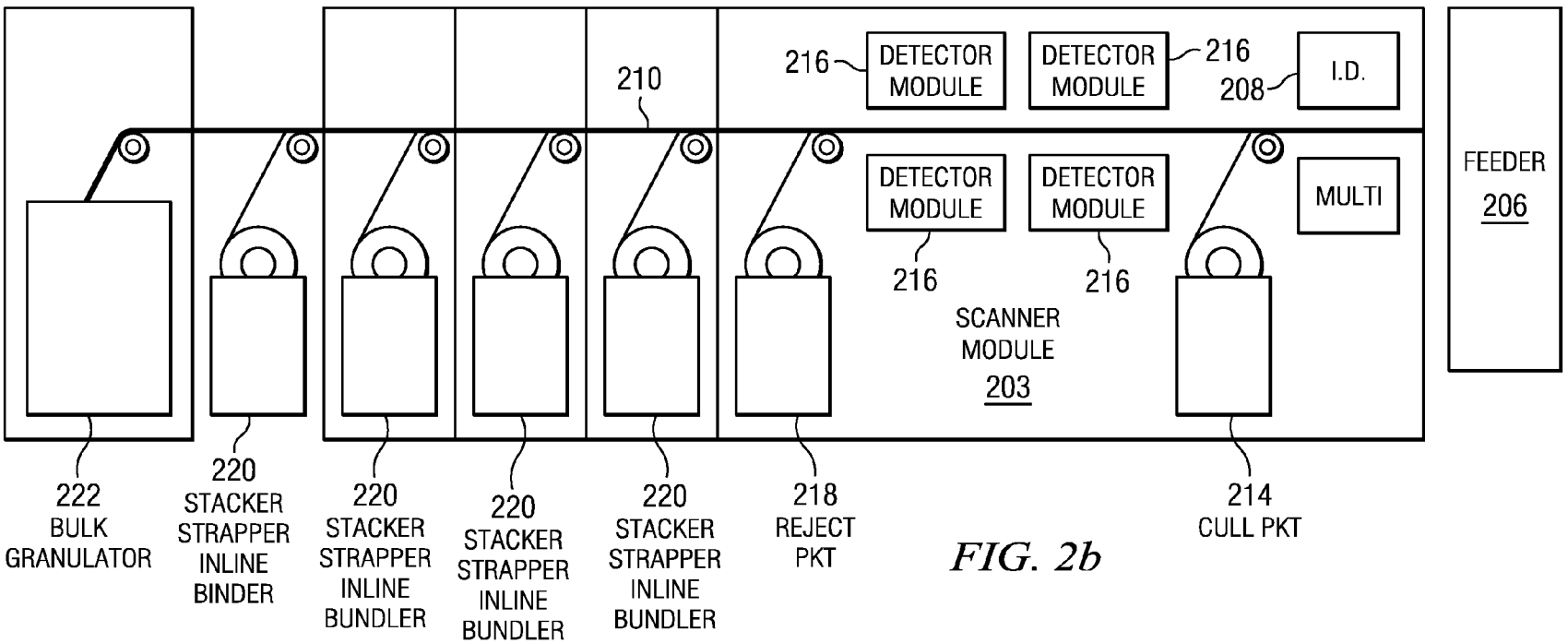
FIG. 2*b* is a schematic representation of a large commercial bank currency processing machine utilizing Applicant's present invention.

Referring to FIG. 2*b*, Applicant's invention is shown in use with a large commercial bank currency processing machine 203. Again shown are the note feeder 206, the cull pocket 214, and the at least one detector 208, which in this instance comprises both an identification detector and a multi-characteristic detector. Also shown is the reject pocket 218, various detector modules 216, and the note path 210. Further shown are a number of stacker, strapper, and inline bundlers 220, which can be used, for example, to accumulate notes of distinct denomination or other specific characteristics. Also shown is a bulk granulator 222 for the destruction of notes identified for such purpose. The bulk granulator 222 is positioned at the furthest downstream position of the note path 210 in the machine illustrated in FIG. 2*b*.

Claim 1 A currency processing machine having a note path, the currency processing machine comprising: a note feeder for introducing notes to the note path; at least one gross defects detector located downstream of the note feeder along the note path; at least one note characteristics detector located downstream of the gross defects detector along the note path; and a cull pocket for collection of notes having gross defects located along the note path between the at least one gross defects detector and the at least one note characteristics detector.

Claim 2 The currency processing machine of claim 1 further comprising: a reject pocket located immediately downstream of the at least one note characteristics detector along the note path.

Claim 3 The currency processing machine of claim 1 further comprising: a note destruction unit located immediately downstream of the at least one note characteristics detector along the note path.

Claim 4 A currency processing machine having a note path and component modules, the currency processing machine comprising: a gross defects module; a detector module downstream along the note path of the gross defects module; and wherein the gross defects module comprises a cull pocket.

Claim 5 A method for processing currency notes, the method steps comprising: (a) feeding notes into a note path; (b) detecting gross defects in the notes fed into the note path; (c) removing notes having gross defects from the note path; (d) detecting for note characteristics those notes remaining in the note path after the removal of notes of steps (c); and (e) sorting the notes of step (d) based on the characteristics detected during step (d).

Claim 6 The method of claim 5, the method steps further comprising: (c)(i) destroying the notes having gross defects immediately following detection.

Claim 7 The method of claim 5, the method steps further comprising: (c)(i) counting the notes having gross defects; (c)(ii) authenticating the notes having gross defects; and (c)(iii) destroying the notes having gross defects.

Claim 8 The method of claim 7, the method steps further comprising: (c)(iv) logging the count and authentication information for the destroyed notes.

The foregoing is merely illustrative of the principles of this invention, and various modifications can be made by those skilled in the art without departing from the scope and spirit of the invention. It should be understood, for example, that Applicant's system described herein can be adapted to prior art currency processing machines of many different makes, models, speeds, and functionality.

I claim:

1. A currency processing machine having a note path, the currency processing machine comprising:

a note feeder for introducing notes to the note path;

at least one gross defects detector located downstream of the note feeder along the note path, wherein the gross defects detector is operable to determine if a note satisfies a predetermined criteria for processing downstream of the gross defects detector based on the tolerances of downstream detection modules and a speed of the note path downstream from the gross defects detector;

at least one note characteristics detector located downstream of the gross defects detector along the note path; and a cull pocket for collection of notes having gross defects not satisfying the predetermined criteria located along the note path between the at least one gross defects detector and the at least one note characteristics detector.

2. The currency processing machine of claim 1 further comprising:

a reject pocket located immediately downstream of the at least one note characteristics detector along the note path.

3. The currency processing machine of claim 1 further comprising:

a note destruction unit located immediately downstream of the at least one note characteristics detector along the note path.

4. A method for processing currency notes in a note processing machine, the method steps comprising:

(a) feeding notes from a note feeder into a note path of the note processing machine;

(b) detecting gross defects in the notes fed into the note path using a gross defects detector by determining if the note satisfies a predetermined criteria for processing downstream of the gross defects detector based on the tolerances of downstream detection modules and a speed of the note path downstream from the gross defects detector;

(c) removing notes having gross defects from the note path to a cull pocket;

(d) detecting note characteristics using a notes characteristic detector for those notes remaining in the note path after the removal of notes of steps (c); and (e) sorting the notes of step (d) based on the characteristics detected during step (d) using a stacker.

5. The method of claim 4, the method steps further comprising:

(c)(i) destroying the notes having gross defects immediately following detection.

6. The method of claim 4, the method steps further comprising:

(c)(i) counting the notes having gross defects;

(c)(ii) authenticating the notes having gross defects; and (c)(iii) destroying the notes having gross defects.

7. The method of claim 6, the method steps further comprising:

(c)(iv) logging the count and authentication information for the destroyed notes.

8. A currency processing machine comprising:

a substantially linear note path;

a note feeder for introducing notes to the note path located at one end of the linear note path;

at least one gross defects detector located downstream of the note feeder along the linear note path;

at least one note characteristics detector located downstream of the gross defects detector along the linear note path;

a cull pocket for collection of notes having gross defects located along the linear note path between the at least one gross defects detector and the at least one note characteristics detector; and a reject pocket located immediately downstream of the note characteristics detector along the linear note path.

9. The currency processing machine of claim 8 further comprising a plurality of stackers immediately downstream of the reject pocket along the linear note path.

10. The currency processing machine of claim 8 or 9 further comprising a note destruction unit downstream of the plurality of stackers.

* * * * *